US009067403B2

(12) United States Patent
Schneider

(10) Patent No.: US 9,067,403 B2
(45) Date of Patent: Jun. 30, 2015

(54) SPRAYING MODULE FOR SPRAYING AN OUTER SURFACE OF A ROTATING CYLINDER

(76) Inventor: Georg Schneider, Wuerzburg (DE)

( * ) Notice: Subject to any disclaimer, the term of this patent is extended or adjusted under 35 U.S.C. 154(b) by 1077 days.

(21) Appl. No.: 13/001,502

(22) PCT Filed: Jun. 18, 2009

(86) PCT No.: PCT/DE2009/000838

§ 371 (c)(1),
(2), (4) Date: Dec. 27, 2010

(87) PCT Pub. No.: WO2009/155898

PCT Pub. Date: Dec. 30, 2009

(65) Prior Publication Data

US 2011/0095098 A1 Apr. 28, 2011

(30) Foreign Application Priority Data

Jun. 28, 2008 (DE) ..... 10 2008 030 779

(51) Int. Cl.

| | |
|---|---|
| ***B41F 7/30*** | (2006.01) |
| ***B41F 7/24*** | (2006.01) |
| *B41F 31/28* | (2006.01) |
| *B05B 15/04* | (2006.01) |
| *B05B 15/06* | (2006.01) |

(52) U.S. Cl.

CPC . *B41F 7/30* (2013.01); *B41F 31/28* (2013.01); *B05B 15/0406* (2013.01); *B05B 15/0443* (2013.01); *B05B 15/069* (2013.01); *B41P 2235/26* (2013.01)

(58) Field of Classification Search

CPC B05B 15/0443; B05B 15/0406; B05B 15/04; B05B 15/0425; B05B 15/0437; B05B 1/26; B05B 1/265; B05B 1/267; B05B 1/262; B05B 1/044; B41F 7/24; B41F 7/30; B41F 7/32; B41F 31/28

USPC ..... 101/147, 132, 132.5, 351.8; 239/265.27, 505–511, 513, 517, 71

See application file for complete search history.

(56) References Cited

U.S. PATENT DOCUMENTS

| | | | | | |
|---|---|---|---|---|---|
| 1,741,169 | A | * | 12/1929 | Thompson | 239/300 |
| 5,025,722 | A | | 6/1991 | Switall et al. | |
| 5,299,495 | A | * | 4/1994 | Schoeps et al. | 101/147 |
| 5,640,907 | A | * | 6/1997 | Tani et al. | 101/366 |
| 5,706,723 | A | | 1/1998 | Ohno | |
| 6,089,153 | A | * | 7/2000 | Regele et al. | 101/147 |

FOREIGN PATENT DOCUMENTS

| | | |
|---|---|---|
| DE | 378050 | 7/1923 |
| DE | 622359 | 12/1935 |
| DE | 26 58 875 A1 | 6/1978 |
| DE | 199 37 135 A1 | 6/2000 |
| EP | 0 344 409 A2 | 12/1989 |
| EP | 0 621 132 A1 | 10/1994 |
| EP | 0 901 903 A2 | 3/1999 |
| EP | 1 004 436 B1 | 7/2003 |

* cited by examiner

*Primary Examiner* — Daniel J Colilla
*Assistant Examiner* — Quang X Nguyen
(74) *Attorney, Agent, or Firm* — Mattingly & Malur, PC

(57) ABSTRACT

The invention relates to a spraying module for spraying the outer surface of a rotating cylinder or roller, for example, a printing cylinder of a rotary printing press, with a liquid mist by means of spray nozzles, wherein the spray direction of the spray nozzle lies in a range, relative to the horizontal, for a spray jet directional angle gamma of 30° to 150°.

13 Claims, 5 Drawing Sheets

Figures 1, 2:
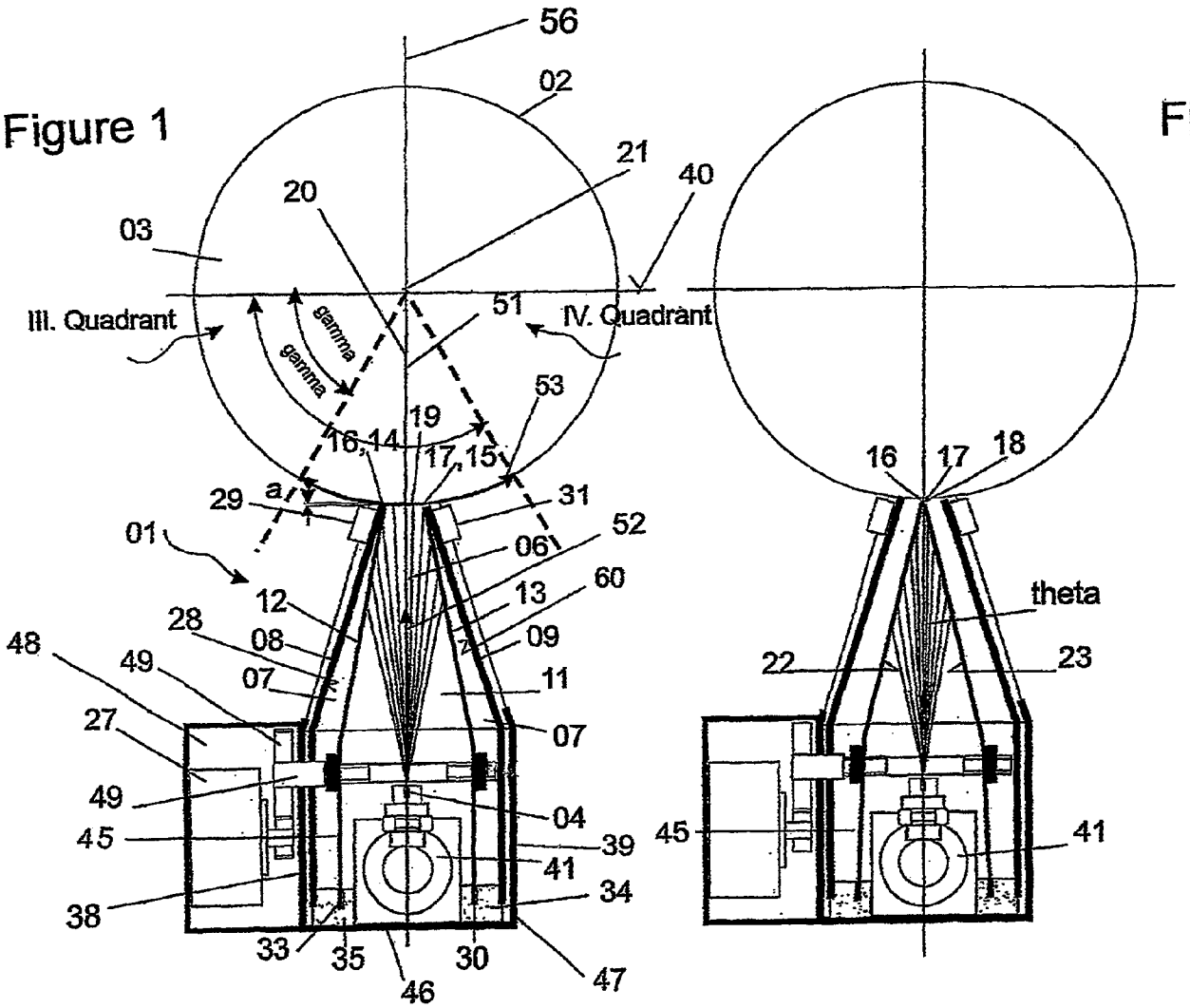

III. Quadrant
IV. Quadrant
gamma
gamma
theta
a
56
02
03
01
20
21
40
51
53
52
31
06
60
13
09
11
07
04
39
34
47
30
46
35
33
38
45
49
27
48
28
08
12
29
14
16
19
15
17
18
22
23
41

SPRAYING MODULE FOR SPRAYING AN OUTER SURFACE OF A ROTATING CYLINDER

The invention relates to a spraying module for an offset printing press, which module cooperates with an outer surface of a plate cylinder which supports a printing form or with a roller that does not support a printing form.

PRIOR ART

DE 622 359 describes an inking unit for printing presses, in which the ink is sprayed onto an inking roller via an atomizing nozzle. The spraying range is determined by a plurality of panels, which form gaps with the surface of the inking roller. At these gaps, the panels each have channels through which excess ink mist is suctioned off and fed to a known suction device.

A spray dampening module of this type has been identified, for example, in EP 1 004 436 B1. Said spray dampening unit has a single nozzle, and one upper rigid and one lower rigid shutter. The two shutters extend over the entire width of the spray dampening unit, and are directed toward a printing couple cylinder. The shutters are positioned so as to form a space, i.e., a catch area, in the intermediate space between them, which catch area is intended to ensure the propagation of spray mist in a desired direction.

EP 0 344 409 A2 describes a spray dampening unit rail comprising a plurality of nozzles and an upper and a lower shutter. The two shutters are capable of pivoting independently of one another, and extend over the entire width of the spray dampening unit rail. The pivotability of the two shutters allows access to the spray nozzles of the spray dampening unit rail.

In EP 0621 132, a spray dampening unit rail having a plurality of spray nozzles has been identified, in which one pivotable shutter per spray nozzle is provided. Each such shutter is a metering shutter with holes. Said metering shutter can be pivoted into the spray cone in order to alternatively cover the spray cone horizontally. The holes in the metering shutter serve to maintain a minimum dampening level in the area they cover. This spray dampening unit rail is not suitable for the direct dampening of printing plates. An intermediate roller must be provided.

In EP 03 44 409 A2 a dampening agent spray rail has been identified, which comprises a plurality of spray nozzles arranged side by side. The spray nozzles spray in a horizontally aligned elongated component, which has one upper and one lower pivotable spray shield, extending the length of the spray rail. Said shields are pivotable to allow access to the roller that is to be wetted.

PROBLEM OF THE INVENTION

The problem addressed by the invention is that of devising an apparatus for the contactless application of a liquid, for example, dampening water, to a printing plate or outer surface of a roller.

This problem is solved by the features of claim 1 or 2.

The apparatus for contactless dampening that forms the basis of this invention advantageously enables a particularly precise dampening of the printing plate in offset printing.

Advantageously, when said apparatus is used for dampening, nozzle dampening units in which the quantity of metered dampening agent is controlled by pulsing the nozzles and/or by adjusting the speed of an interconnected dampening fountain roller can be dispensed with. This offers the advantage of preventing irregularities in the print image caused by the disadvantageous pulsing of the dampening agent, particularly in high-speed machines. The apparatus according to the invention has the further advantage that the formation of the flat jet is always even because it is not frequency dependent. This, in turn, has a positive effect, when flat jet nozzles are used, on the uniform distribution of the spray mist over the entire misting or spray pattern when the liquid is applied. The dimensional tolerances of the plurality of spray nozzles of the same type used on a spray rail theoretically and practically allow a quantity of spray medium to be dispensed per unit of time through each spray nozzle that is used, said quantity being different from that of an adjacent nozzle while the spray medium pressures are the same.

In other words, different quantities of dampening agent per unit of time and per spray nozzle would be dispensed, which would be evident in the print image. Heretofore, disadvantageous attempts have been made to compensate for this by means of a costly modification of the frequency of the "pulses" of the dampening agent, with greater or lesser success.

The embodiments of the shutter arrangement according to the invention, described in what follows, can also be used in a spray dampening unit of a printing press, particularly a rotary offset printing press, and in a printing couple of a web-fed or sheet-fed rotary printing press.

The present invention will be specified in greater detail in what follows within the context of schematically illustrated exemplary embodiments, in reference to the drawings listed below.

The drawings show

Figure 4:
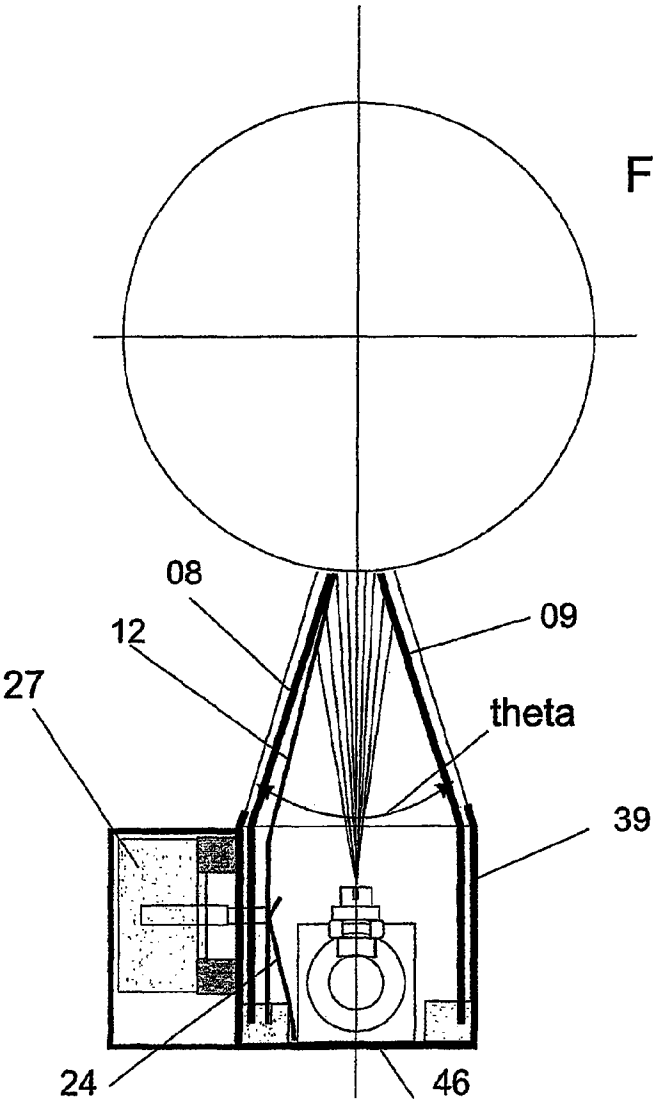
Figure 3:
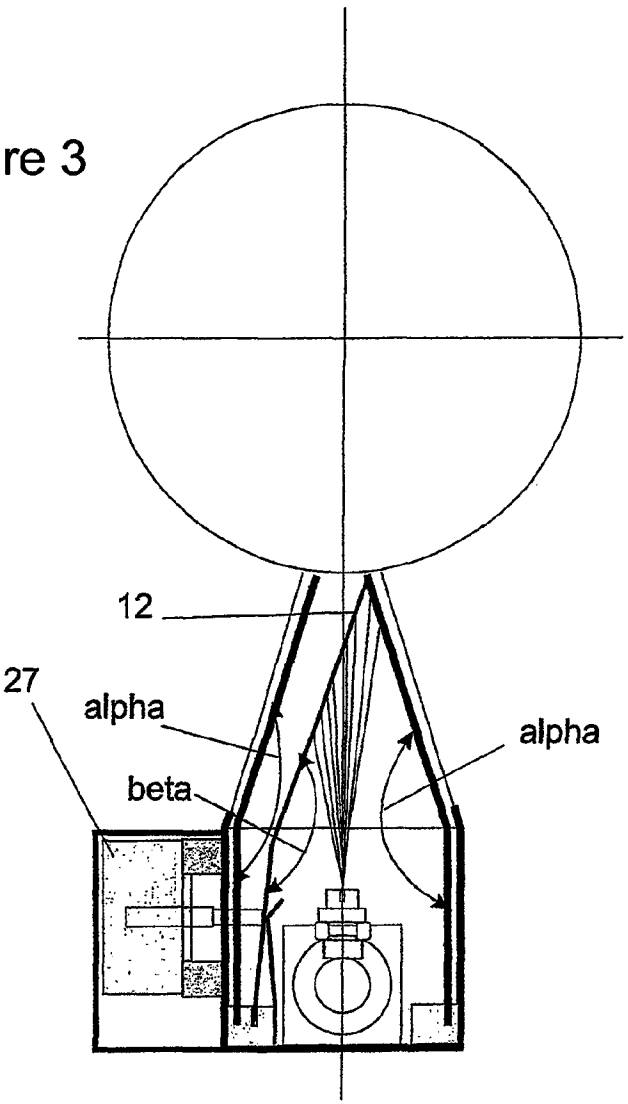
Figure 6:
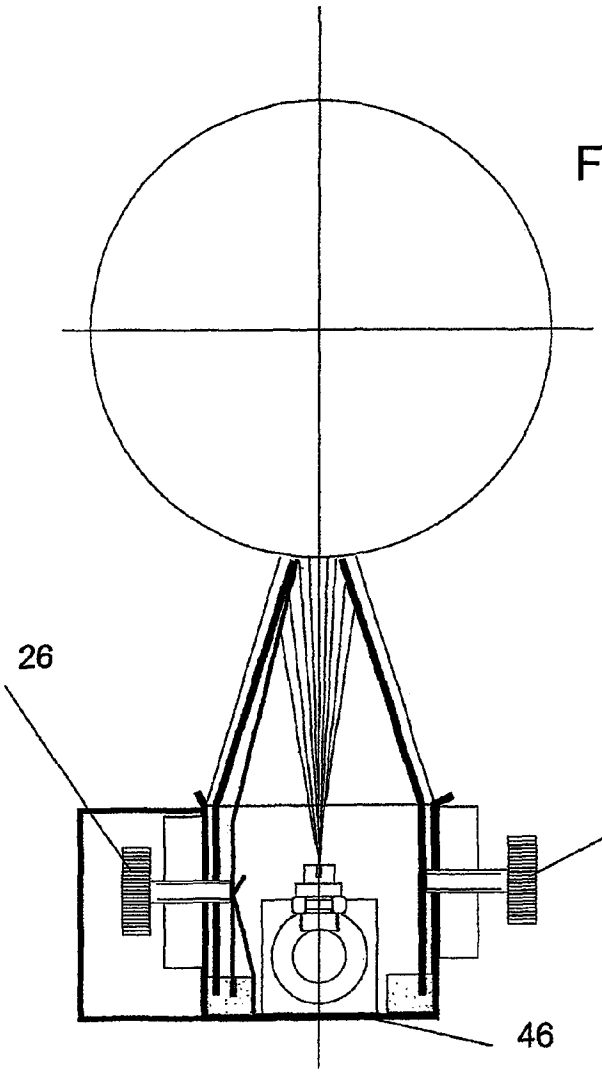
Figure 5:
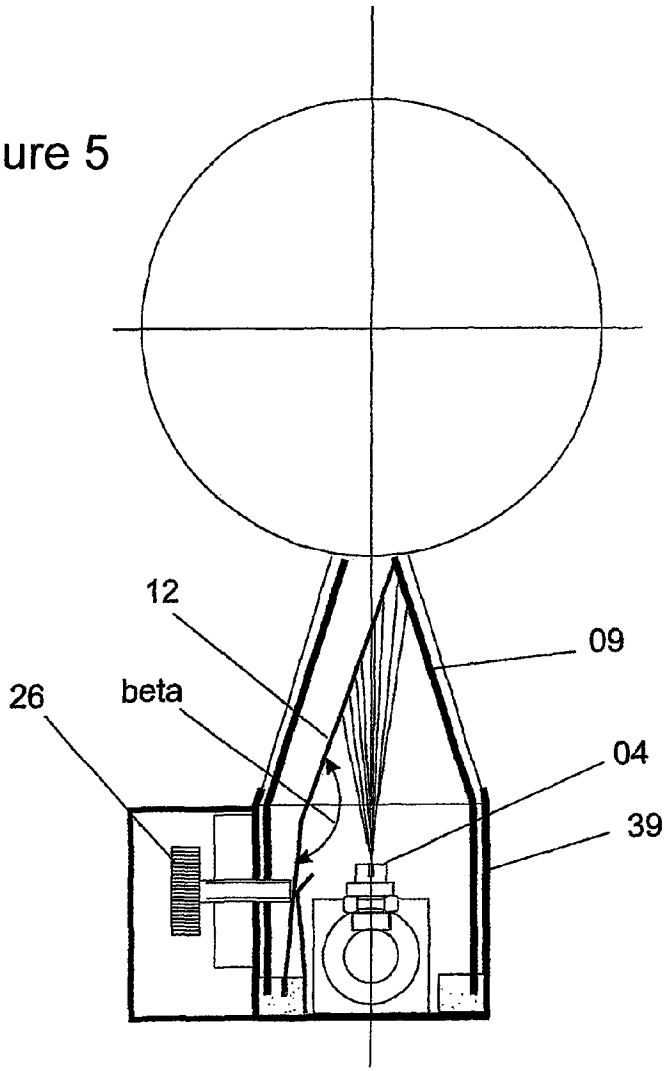
Figure 7:
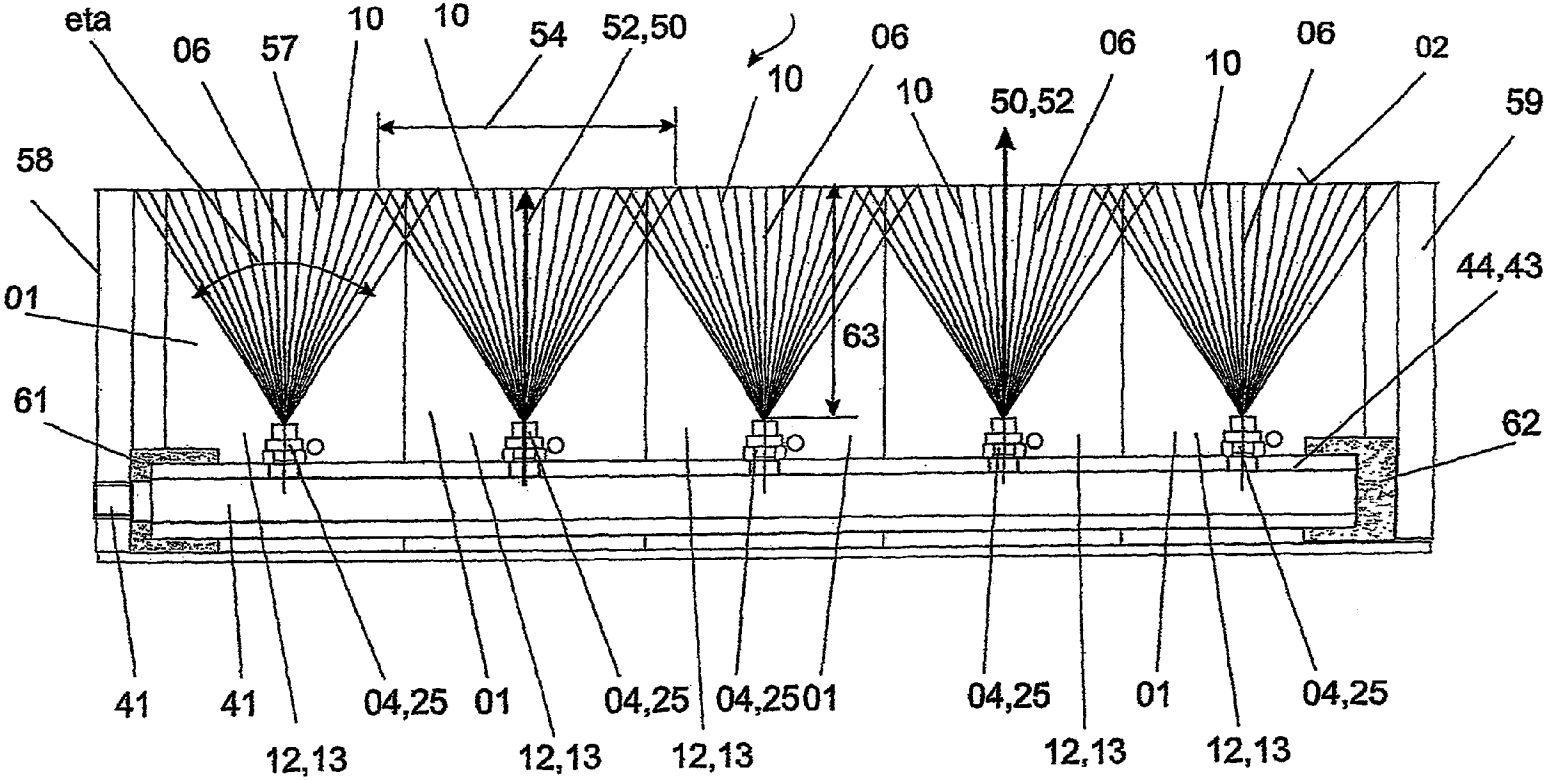
Figures 8A, 8B:
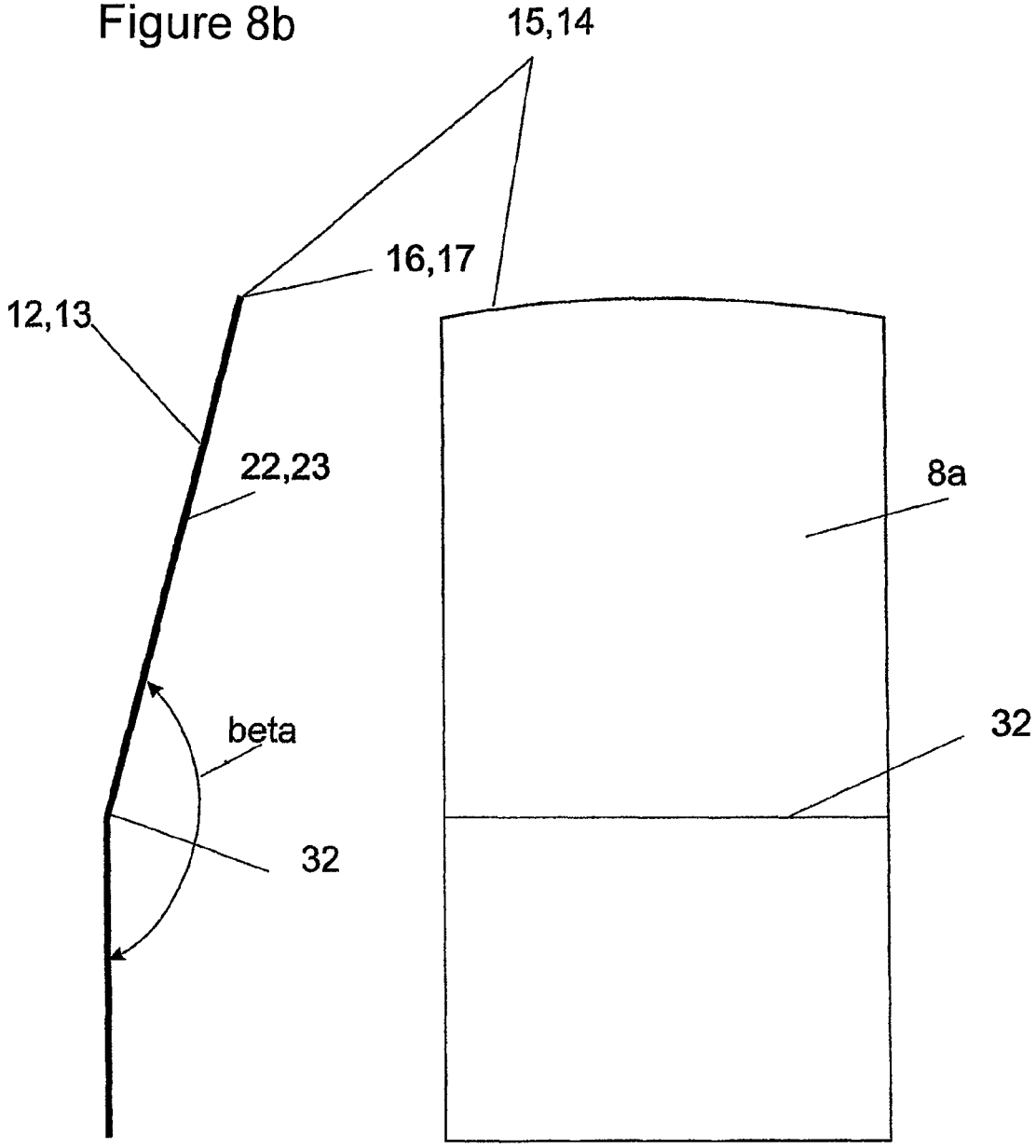

FIG. 1 a schematic side view of the spray dampening module according to the invention with both metering shutters in the spraying position;

FIG. 2 a schematic side view of the spray dampening module according to the invention with both metering shutters in the spray closed position;

FIG. 3 a schematic side view of the spray dampening module according to the invention with only the left controllable metering shutter, in the spray closed position, with a motorized adjustment drive;

FIG. 4 a schematic side view of the spray dampening module according to the invention with only the right controllable metering shutter, in the spraying position, with a motorized adjustment drive;

FIG. 5 a schematic side view of the spray dampening module according to the invention, with only the left controllable metering shutter, in the spray closed position, with a manual adjustment drive;

FIG. 6 a schematic side view of the spray dampening module according to the invention, with the one controllable metering shutter and one controllable outershutter, which cooperates with the former shutter, in the spray position, and with a manual adjustment drive;

FIG. 7 a schematic plan view of a spray dampening module rail according to the invention, with a plurality of spray dampening modules according to the invention, but without outershutters and without metering shutters, with only the left controllable metering shutter, in the spray closed position, and with a manual adjustment drive;

FIG. 8*a* a schematic front elevation view of a metering shutter with a non-straight upper end with a non-straight edge;

FIG. 8*b* a schematic side view of the metering shutter according to FIG. 8*a*.

The following description describes the subject matter within the context of the related figures.

Every individual spray nozzle has its own, i.e., "specific," spray pattern, conditioned by its dimensional tolerances in terms of length, cross-sectional shape, cross-sectional size, and direction of the nozzle channel of the respective spray nozzle. As a result, based upon the predetermined spray distance from the tip of the nozzle, different spray nozzles have different spray values, such as fluid density, droplet size, spray pattern shape, etc., which must be adjusted to match one another on-site.

With the method and apparatus according to the invention, these specific differences can be compensated for in the simplest manner. Moreover, the quantity of liquid delivered, e.g., the quantity of dampening agent, can be easily matched to the print image, because the quantity of dampening agent applied is based upon the print image. More dampening agent is required for a solid image than for a text-only image.

In the past, attempts have been made to compensate for this in dampening units by providing two nozzles per newspaper page, and by controlling these via the pulse frequency, which in turn has resulted in the above-described problems.

The solutions according to this invention represent a novel departure from the "pulsing technique." Here, a spraying module, for example, a nozzle dampening module, is proposed, which does not have the above-described disadvantages.

The spraying modules 01 according to the invention operate with spray nozzles 04, which spray continuously. At a predetermined dampening agent pressure, this ensures a "typical" embodiment of a spray pattern for each spray nozzle 04. Flat jet spray nozzles 04, which produce a flat jet 57, for example, with an elliptical spray pattern or, for example, a flat jet with a rectangular spray pattern, are particularly well suited for the purpose of this invention. However, flat jet spray nozzles in a deflector or baffle plate design can also be used, which produce a spray pattern having relatively sharp edges. The practical spray width 54 along a surface line of an outer surface 02 is determined by selecting the size of the opening angle eta of the spray angle of the spray nozzle 04 and by selecting the spray distance 63 thereof from the outer surface 02. The spray width 54 corresponds to the respective spray length in millimeters along a surface line on the outer surface 02, and ranges, for example, from 50 to 70 millimeters. The opening angle eta of the spray angle measures between 15° and 150°, for example.

The invention involves a method for spraying a liquid, for example, dampening water, onto an outer surface 02 of a rotating cylinder 03 or roller, for example, a printing couple cylinder 03, of an offset rotary printing press using at least one spray nozzle 04, which produces a continuous, pressurized liquid spray mist 06. This liquid spray mist or, more particularly, dampening agent spray mist 06 is moved in the direction of the co-rotating outer surface 02 of the cylinder 03 or roller by the kinetic energy inherent to said mist after it exits the nozzle, through the metering chamber 11 formed by two shutters, one left metering shutter 12 and one right metering shutter 13 which cooperates with the former shutter, the relative angles of which shutters can be adjusted. Each of the metering shutters 12, 13 has a continuous left edge 16 or continuous right edge 17 at its respective end 14 or 15 that faces the outer surface 02. The metering shutters 12 and 13 are capable of moving parallel or nearly parallel to the rotational axis 21 of the cylinder or roller 03 at a slight distance a (e.g., 0.3 mm) up to and away from the outer surface 05. The metering shutters 12, 13 are angled relative to one another and can be moved individually or together, in or counter to the direction of rotation of the cylinder or roller 03. The two ends 14, 15 or edges 16 and 17 of the left metering shutter 12 and right metering shutter 13, respectively, can ultimately touch one another in a closed position 18. In this case, an angle of intersection—also called a wedge angle (delta)—is at its smallest possible value between the two planes which span the two flat interior surfaces 28, 40 of the respective metering shutters 12 and 13. From this closed position 18, the two metering shutters 12 and 13 can be adjustably moved away from one another for metering, such that between their edges 16 and 17, a rectangular outlet slot 19 is formed for the delivery of a spray jet 57 of the liquid or dampening agent spray mist 06 in the direction of the outer surface 02 of the cylinder or roller 03 that is to be dampened. The rectangular outlet slot 19 has an adjustable slot width (b), which can measure between 0 mm and 15 mm, for example. The length l of the outlet slot 19, extending parallel to the rotational axis 21 of the cylinder 03, of each spray nozzle 04 can be 50 mm to 70 mm, for example, but may also be longer or shorter. The length of the outlet slot 19 preferably corresponds to the distance between the centers of the outer nozzle opening of two adjacent spray nozzles 04.

The rectangular outlet slot 19 is preferably situated a short distance a (e.g., approx. 0.5 mm) from the outer surface 02. The distance a changes in accordance with the size of the pivot angle of the metering shutter 12, 13.

In contrast to the prior art, the flat spray jet 57 of the spray nozzles 04 is not "clipped" at the top, the bottom, the right or the left by means of a sharp "barrier."

In the invention, because the surfaces which are flat at least on their respective interior sides 22, 23 are arranged in an acute adjustment angle (delta), the metering shutters 12, 13 extending toward one another act as a funnel having a rectangular outlet. In other words, a funnel with flat walls, situated opposite one another. The flat spray jet 57 that is forced between the interior sides 22, 23 of the two metering shutters 12, 13, for example, the "liquid mist"—spray—flat jet 10, receives its rectangular cross-sectional shape on its way to the outlet slot 19, and thereby deliberately loses part of its liquid or dampening agent mass. Finally, the compressed dampening agent mist exits the opened rectangular outlet slot 19, and ultimately strikes the outer surface 02 of the cylinder 03, wetting it.

By widening or narrowing the outlet slot 19 via a corresponding pivoting of the two metering shutters 12, 13 away from one another and toward one another, the quantity of dampening agent dispensed through the outlet slot 19 per unit of surface area can be adjusted.

The spraying module 01 according to the invention, preferably for dampening a rotating surface 02 of a cylinder 03 or roller, for example a printing couple cylinder, of an offset rotary printing press has at least one spray nozzle 04 for generating a continuous spray jet 57 of a spray mist 06. The spraying module 01 has a mounting chamber 07 between two outershutters 08, 09, spaced from one another. They are directed toward the outer surface 02. They extend at an acute angle (wedge angle) theta in relation to one another.

One pivotable metering shutter, for example, the right metering shutter 13, can be dispensed with, and instead, a rigid outershutter, for example, the right outershutter 09, can be used.

Inside the mounting chamber 07, a metering chamber 11 which is separated from the mounting chamber 07 is formed by at least one metering shutter 12, 13 oriented in the direction of the outer surface 02. The spray direction 52 of the spray nozzle 04 is directed into the metering chamber 11. The metering shutter 12 and/or 13 is capable of pivoting in the direction of the outershutter, e.g., 09 (FIG. 3), arranged opposite it, thereby enlarging or narrowing the metering chamber 11.

The metering of the quantity of liquid, for example, the quantity of dampening agent, over the width of a printing form, and the adjustment to the speed of the press can be carried out by means of at least one pivotable or flexible metering shutter 12 or 13. The metering shutters 12, 13 in the embodiment example are preferably embodied as rustproof, flexible, and metallic leaf springs. The metering shutters 12, 13 could also be made of high-strength, flexible plastic. The metering shutters 12, 13 are bent, for example, at obtuse angles, wherein the bending line 32 is located, for example, at the top of the lower one-third of the length of the metering shutters 12, 13. The angled design of the metering shutters 12, 13 makes it possible to shorten the adjustment path of the metering shutters 12, 13, because they do not need to be adjusted over their entire length. The force of each of the adjustment devices 26; 27 is applied to the metering shutters 12 or 13 shortly in front of the respective bending line 32—as viewed from the bottom end 33—in order to steer them out of their respective positions.

In place of the elastic leaf spring embodiment, a hinge could also be provided along the imaginary bending line 32, between the lower one-third and the remaining two-thirds of the length of the metering shutters 12, 13. However, this embodiment is more costly.

The last part 33 of the lower one-third of the metering shutters 12, 13 is provided as an abutment for the leaf-spring type metering shutters 12, 13. The lower end 33 of metering shutter 12 is fastened in a left clamping strip 35; the lower end 30 of right metering shutter 13 is fastened in a right clamping strip 34. The two clamping strips 34 and 35 are attached to the base 46 of a U-shaped bracket 47, spaced from one another. On the exterior side, for example, of the left leg 38 of the U-shaped bracket 47, a transmission case 48, sealed against the surrounding environment, is attached. The drive 49 for one or both metering shutters 12, 13 is located inside the transmission case 48. Nothing is attached to the right leg 39 of the bracket 47.

A pipe 41 for supplying all of the spraying modules 01 arranged side by side in a row with a pressurized liquid, for example, dampening fluid, runs through the interior of a U-shaped bracket 47. In the upper part of said pipe, which faces the metering chamber 11, a plurality of threaded bored holes are provided, extending through the pipe wall. A spray nozzle 04 is attached to each threaded bored hole. The interior of the pipe 41 is continuously filled with a pressurized liquid, for example, dampening agent. A plurality of spraying modules 01 can be arranged side by side and fastened onto the supply pipe 41, forming a spray rail 42. A left side plate 58 and a right side plate 59 are provided for fastening the spray rail 42 between side frames of a printing couple (not shown). A left block 61 is fastened onto the interior wall of the left side plate 58. A right block 62 is fastened onto the interior wall of the right side plate 58. One end of the pipe 41, which serves as the spraying module support 44, is non-rotatably arranged in each of the bored holes in the blocks 61, 62.

The following angle data on the range of the spray jet directional angle gamma relate to a rectangular system of coordinates, the zero point 0 of which coincides with the rotational axis 21 of the cylinder 03 to be sprayed.

The spray rail 42 according to the invention is equipped with a plurality of mounted spraying modules 01, each of which supports a spray nozzle 04 with a nozzle tip 25, for example. Each of the spray nozzles 04 generates a spray jet 57, which is directed toward the outer surface 02 and wets it with a liquid, for example, dampening agent. The spray direction 52 of each spray nozzle 04 is inclined from vertical in such a way that the "stray" liquid is able to return, by the force of gravity, on the interior sides 28, 60 of the outershutters 08, 09 in the space between the interior side 28, 60 of the respective outershutter 08 or 09 and the exterior side 45, 55 of the respective metering shutter 12 or 13, without disrupting the spray jet 57.

The spray jet which passes through the nozzle center and moves in the spray direction 52 is referred to as the central jet 50.

The spray direction 52 of the spray nozzles 04 in the spraying module 01, and thus also the (theoretical) central jet 50, is therefore always oriented or at least directed toward the outer surface 02 and the rotational axis 21 of the cylinder 03. The nozzle 04 is inclined toward a horizontal plane, which intersects the rotational axis 21, in such a way that the respective spray jet directional angle gamma, in other words the angle between the horizontal plane and the central jet 50 of the nozzle 04, is directed toward the outer surface 02 at an angle of 30° to 150°.

The practical spray width 54 corresponds to a fraction of the width of the outer surface 02 of the cylinder 03.

The arrangement of the spraying modules 01 or the spray rail 42 in the manner described above therefore has the particular advantage that the "stray" liquid, for example, dampening water, does not disrupt the spray jet 57 to a significant degree, because the "stray" liquid is able to return, by the force of gravity, on the interior sides 28, 60 of the outershutters 08, 09 in the space between the interior side 28, 60 of the respective outershutter 08 or 09 and the exterior side 45, 55 of the respective metering shutter 12 or 13. An exception to this occurs when the outer edge 16 or 17 comes to rest against the outershutter 08 or 09, respectively, in a straight line, forming a seal.

The interior sides 28, 60 of the outershutters 08, 09, and/or the exterior sides 40, 45 of the metering shutters 12, 13 can preferably be equipped with a coating that supports the flow of dampening agent. Coatings with nanostructures, so-called nanocoatings, which contain micro particles (nano particles), are suitable on these surfaces, for example. As a result, these surfaces become superhydrophobic (stray dampening fluid droplets that reach the aforementioned surfaces form beads and run off easily) or superhydrophilic (stray dampening fluid droplets that reach the aforementioned surfaces form a fluid film and, if applicable, run off easily). In place of this, a film designed according to the principle of shark skin can also be applied.

Because the spray pattern does not form linearly over its width with the dampening module 01 according to the invention, and because the spray quantity tolerance also lies within an order of 5-10%, this can be compensated for through the embodiment and adjustment of the metering shutters 12, 13. The metering of the different quantities of water required for the print image can be made significantly more precise by adjusting the metering shutters 12, 13. The pivot angle of the metering shutters 12 and 13 can be adjusted either manually via an adjustment screw 26 or with an electromotive remote adjustment 28, 29 of each shutter.

A further advantage of the spraying module 01 according to the invention is that at the ends of each of the outershutters 08, 09 a vacuum strip 29, 31 can be attached. The purpose of said strips is to suction off stray water droplets found outside of the spraying module 01. The advantage of this is that no uncontrolled liquid mist can reach the printing couple.

The edges 16, 17 of the metering shutters 12, 13 need not be rectilinear. They can also have another shape, for example curved (see also FIGS. 8*a*, 8*b*).

The spraying modules 01 are arranged and attached side by side in a horizontal direction on a support device 43, for example, the pipe 41, forming a spray rail 44.

The spray nozzles 04 can also be attached by means of mounting pipe clamps or hinged pipe clamps, allowing them to be rapidly replaced.

The outershutters 08, 09 extend at least over the width of a spraying module 01. Preferably, they extend in multiple pieces over multiple spraying modules 01 or in one piece over all spraying modules 01, i.e., over the entire length of the spray rail 42.

If the metering shutter 12, 13 has a separate drive, a restoring spring 24, for example, a pressure leaf spring, is provided. Its force acts upon the lower one-third of the length of the metering shutter 12, 13, and its abutment is attached to the base 46. The purpose of the restoring spring 24 is to press the metering shutter 12, 13 in the direction of the outershutter 08, 09 assigned to it.

LIST OF REFERENCE SYMBOLS

01 Spraying module
02 Outer surface (03)
03 Cylinder, roller
04 Spray nozzle
05 Outer surface (03)
06 Spray mist
07 Mounting chamber
08 Outer shutter, left
09 Outershutter, right
10 Flat spray jet
11 Metering chamber
12 Metering shutter, left
13 Metering shutter, right
14 End (12)
15 End (13)
16 Edge (12)
17 Edge (13)
18 Closed position
19 Outlet slot (12; 13)
20 Spray cone center
21 Rotational axis (03)
22 Interior side (12)
23 Interior side (13)
24 Compression spring
25 Nozzle tip
26 Adjustment screw
27 Adjustment drive
28 Interior side (08)
29 Vacuum strip (08)
30 End, lower (13)
31 Vacuum strip (09)
32 Bending line
33 End, lower (12)
34 Mounting strip (13)
35 Mounting strip (12)
36 Strip
37 Adjustment screw
38 Leg, left (47)
39 Leg, right (47)
40 Plane, horizontal
41 Pipe
42 Spray rail
43 Support device (01)
44 Spraying module support
45 Exterior side (12)
46 Base (47)
47 Bracket U-shaped
48 Transmission case
49 Drive
50 Central beam
51 Straight line
52 Spray direction
53 Arc length
54 Spray width
55 Exterior side (13)
56 Plane, vertical
57 Spray jet
58 Side plate, left
59 Side plate, right
60 Interior side (09)
61 Block, left
62 Block, right
63 Spray distance
alpha Bending angle (08, 09)
beta Bending angle (12, 13)
gamma Spray jet directional angle
delta Wedge angle (12, 13)
eta Spray angle (04)
theta Wedge angle (08, 09)

The invention claimed is:

1. A dampening unit spraying module for spraying an outer surface of one of a cylinder and a roller of a printing couple of a rotary printing press with a liquid mist and which is rotatable about its rotational axis, by the use of at least one spray nozzle, the spraying module including a mounting chamber formed between first and second outer shutters which are spaced from one another, a size-adjustable metering chamber being provided in the mounting chamber formed by the first and second outer shutters, the at least one spray nozzle being arranged inside the size-adjustable metering chamber, the size-adjustable metering chamber including first and second metering shutters positioned inside the mounting chamber defined by the first and second outer shutters, which first and second metering shutters are spaced from one another and which are pivotable toward and away from one another, the first and second metering shutters each having an interior side and each being bent at an obtuse angle, and each being arranged with the obtuse angles of their respective interior sides being opposite one another and parallel to the rotational axis of the cylinder, the first and second metering shutters being directed toward the outer surface and being supported by the spraying module, a central jet of the at least one spray nozzle, and a spray direction of the at least one spray nozzle, being directed in the metering chamber onto the outer surface, and toward the rotational axis, in a spray jet directional angle, with the spray jet directional angle, relative to a horizontal plane which intersects the rotational axis of the one of the cylinder and roller, lying in a range of 30° to 150° in the IIIrd to the IVth quadrants of a rectangular system of coordinates, the center of which is on the rotational axis.

2. The dampening unit spraying module according to claim 1, characterized in that ends of the first and second metering shutters are arranged spaced from the outer surface of the at least one of the cylinder and roller.

3. The dampening unit spraying module according to claim 1, characterized in that the first and second outer shutters are each angled at an obtuse angle, and wherein said obtuse angles of said first and second outer shutters are opposite one another.

4. The dampening unit spraying module according to claim 1, characterized in that when one of the outer shutters and one of the metering shutters are directly adjacent to one another, the obtuse angle on the interior side of the outer shutter and a reflex angle on an exterior side of the metering shutter are opposite one another, respectively.

5. The dampening unit spraying module according to claim 1, characterized in that the metering shutters are made of spring steel.

6. The dampening unit spraying module according to claim 1, characterized in that a drive for pivoting the metering shutters is provided.

7. The dampening unit spraying module according to claim 6, characterized in that an electromotive drive is provided as said drive for pivoting the metering shutters.

8. The dampening unit spraying module according to claim 1, characterized in that a device for suctioning off leaked dampening fluid is provided on the exterior side of the end of each outer shutter.

9. A spray rail comprising a plurality of the dampening unit spraying modules according to claim 1.

10. The spray rail according to claim 9, characterized in that the outer shutters extend in one piece over the entire length of the spray rail.

11. The dampening unit spraying module according to claim 1, characterized in that the outer shutters extend at least over the width of a spraying module.

12. The dampening unit spraying module according to claim 1, characterized in that each of the outer shutters extends over the width of a plurality of spraying modules.

13. The dampening unit spraying module according to claim 1, characterized in that the spray nozzle is a flat jet nozzle.

* * * * *